US006268835B1

(12) United States Patent
Toland et al.

(10) Patent No.: US 6,268,835 B1
(45) Date of Patent: Jul. 31, 2001

(54) DEPLOYABLE PHASED ARRAY OF REFLECTORS AND METHOD OF OPERATION

(75) Inventors: Brent T. Toland, Manhattan Beach; L. Dwight Gilger; Ronald Y. Chan, both of Torrance; Alon S. Barlevy, Cerritos; Shinobu J. Hamada, Rancho Palos Verdes, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/480,699

(22) Filed: Jan. 7, 2000

(51) Int. Cl.[7] ..... H01Q 21/00

(52) U.S. Cl. ..... 343/781 P; 343/781 R; 343/840; 343/915; 343/DIG. 2

(58) Field of Search ..... 343/781 P, 776, 343/844, 853, 915, DIG. 2, 781 R, 840, 775; 342/74, 368; H01Q 21/00, 19/14

(56) References Cited

U.S. PATENT DOCUMENTS 4,482,897 * 11/1984 Dragone et al. ..... 343/781 P
4,896,165 * 1/1990 Koizumi ..... 343/881
5,440,320 * 8/1995 Lach et al. ..... 343/915
5,680,145 * 10/1997 Thomson et al. ..... 343/915
5,734,345 * 3/1998 Chen et al. ..... 342/74
5,936,592 * 8/1999 Ramanujam et al. ..... 343/853
5,990,851 * 11/1999 Henderson et al. ..... 343/915
6,041,232 * 3/2000 Jennings, III ..... 455/422

* cited by examiner

*Primary Examiner*—Don Wong
*Assistant Examiner*—Hoang Nguyen
(74) *Attorney, Agent, or Firm*—Robert W. Keller

(57) ABSTRACT

A deployable phased-array-of-reflectors antenna includes individual reflectors and feed arrays. Each feed array is disposed above a corresponding individual reflector. The individual reflector antennas are preferably disposed adjacent to one another (e.g., on a hexagonal lattice) to form a phased array antenna using the individual reflectors antennas as elements. Phase and amplitude control electronics are coupled to each reflector antenna to provide steering for the signal energy coupled between the reflectors and the feed arrays. Switching electronics are coupled to the feed arrays and selectively activate and deactivate beam forming clusters of feeds in the feed arrays. A method for generating a steerable antenna pattern couples signal energy through a beamforming section to form steered signal energy. Next, the method couples the steered signal energy between a phased array of reflector antennas. The method selectively activates a first feed cluster for a first reflector, a second feed cluster for a second reflector, and so on, until feed clusters are activated in all of the reflectors in the array. The method then couples the steered signal energy between the first and second feed clusters. The method subsequently activates and deactivates the feed clusters to reduce the impact of grating lobes in the total antenna pattern, or when a particular cluster attenuation has been reached.

38 Claims, 14 Drawing Sheets

DEPLOYABLE PHASED ARRAY OF REFLECTORS AND METHOD OF OPERATION

BACKGROUND OF THE INVENTION

The present invention relates to satellite antenna systems. In particular, the present invention relates to a deployable phased array of reflector antennas that provides scanning capability using reflector antennas as elements.

Spaceborne communication applications often rely on deployable reflector antennas to achieve high gain. The deployable reflector antenna uses one or more feeds located at or near the reflector focal point, for example, to receive energy focused by the reflector at the focal point. An alternative type of antenna, the direct radiating phased array antenna, is built using a large number of direct radiating elements spaced closely together on a lattice, and is often impractical for space applications.

In many communication applications, an antenna with a large effective aperture size is desired. The aperture size refers to the physical size of the antenna, and, as the aperture size increases, the sensitivity or "gain" of the antenna increases, with a concomitant reduction in beamwidth. A large aperture size thus produces a narrow beam that allows an antenna to receive or transmit energy from or to a very precise point. For example, a large aperture antenna is more effective at collecting, focusing, finding and pinpointing the energy emitted by a distant star.

In addition to having a large aperture, many antennas preferably have agile scan capability, which is the ability to rapidly (i.e., electronically, instead of mechanically) scan a transmit or receive beam over a wide angular range. In a phased array antenna, a set of amplitude and phase control electronics drive each radiating element. The control electronics are typically quite flexible and allow a phased array antenna to achieve an enormous angular range. For example, a phased array antenna may have an angular range of ±30 to ±45 degrees. Unfortunately, as the aperture size of a phased array antenna increases, the amount of radiating elements and associated control electronics drastically increases, with a concomitant increase in power consumption, thermal dissipation and weight. The complexity of the structural design and the deployment also increase drastically. In other words, large aperture phased array antennas are impractical from economic and engineering standpoints.

A deployable mesh reflector antenna, on the other hand, readily achieves very large aperture sizes with very low weight and stow volume. As a reflector antenna increases in size, however, its angular steering range becomes more limited due to optical aberrations which degrade antenna sensitivity (or "gain"). Although longer focal lengths or multiple feeds may be used in a reflector to increase the angular scanning range, the fact remains that the angular scan range of a reflector decreases as the reflector size increases. Furthermore, as the aperture size increases and the beam width narrows (which in most instances is a desirable condition that creates a high power beam), an increasingly smaller feed handles an increasing amount of power. However, the amount of power that practical feeds and electronics can handle is limited by breakdown, multipaction or heating.

Therefore, in the past, practical reflector antennas have been limited to approximately 10 to 20 beamwidths of scan, and signal power levels are constrained. A phased array antenna, on the other hand, has the ability to scan several hundred beamwidths. Further, the phased array distributes energy over numerous antenna elements and has the capability for handling much higher levels of power. As noted above, however, it is usually impractical to construct a large aperture phased array antenna.

Spaceborne antennas, of course, reach orbit in a launch vehicle. Launch vehicles are extremely expensive, and any reduction in size and weight generally results in a reduced cost to launch. Thus, although large aperture antennas are desirable, the aperture size has, in the past, been limited by the launch cost, size of the launch vehicle, and the extent to which the antenna can be folded or packed together into the launch vehicle. Thus, there is a further need for a cost effective, light weight, compact large aperture antenna that is economical to launch.

A need has long existed in the industry for a new antenna that overcomes the problems noted above and previously experienced.

BRIEF SUMMARY OF THE INVENTION

Another aspect of the present antenna is that it shares characteristics of both phased array antennas and reflector antennas.

A feature of the present antenna is that it shares a phased array of reflectors antenna that provides scanning capability using reflector antennas as elements.

Another feature of the present antenna is a phased array of reflectors antenna with a controllable reflector element pattern that is selected via switching, based on grating lobes or signal attenuation from the array fed reflectors.

Yet another aspect of the present antenna is a deployable phased reflector array antenna with signal phase and amplitude steering electronics.

Another feature of the present antenna is a structure that shares interface boundaries with adjacent reflector antennas, and that uses a shaping surface to help form a reflector surface.

The present phased array of reflectors antenna includes reflector antennas formed using individual reflectors and feed arrays. Each feed array is disposed above a corresponding individual reflector, for example at the reflector focal point. The individual reflector antennas are preferably disposed adjacent to one another (e.g., on a hexagonal lattice) to form a phased array antenna from the individual reflector antennas.

The individual reflectors and feeds that make up the feed arrays, for example, may be arranged approximately on a regular reflector lattice, with pseudo random offset to compensate for grating lobes as discussed below. Phase and amplitude control devices (electronic, photonic or digital) are coupled to each reflector antenna to provide steering for the signal energy coupled between (i.e., received from or transmitted through) the reflectors and the feed arrays. Switching electronics are coupled to the feed arrays and selectively activate and deactivate beam forming clusters of feeds in the feed arrays. The switching electronics, as explained in more detail below, thereby help avoid the effects of grating lobes in the total antenna pattern formed by the phased reflector array antenna.

The present phased array of reflectors generates an antenna pattern that is the product of an array pattern and an array fed reflector element pattern. The array pattern is generated assuming ideal point sources at each reflector location in the reflector array lattice, while the array fed reflector element patterns are generated by selectively illuminating each reflector with the array feed located above the reflector.

One embodiment of the present method for generating a steerable antenna pattern couples signal energy through a beamforming section or network to form steered signal energy. Next, the method couples the steered signal energy between an array of reflector antennas. As noted above, the reflector antennas are preferably disposed adjacent to one another to form a phased array antenna in which the individual reflector antennas are considered radiating (or receiving) elements.

The method selectively activates feed clusters within each array located above each reflector. As an example, identical feed clusters would be selected in each of the 91 array fed reflectors shown in FIG. 1. The signal from each of these clusters would then be routed to a common beamformer to be appropriately delayed and combined.

Signal energy propagates to the array of reflector antennas and to the first and second feed clusters to transmit signal energy. Conversely, the method couples signal energy from the array of reflector antennas and from the first and second feed clusters to receive signal energy. The method also selectively deactivates the first feed cluster and activates a third feed cluster, and selectively deactivates the second feed cluster and activates a corresponding fourth feed cluster. The third feed cluster is selected from feeds in the first feed array, and the fourth feed cluster is selected from feeds in the second feed array. The method activates and deactivates the feed clusters in a manner that minimizes the impact of grating lobes in the total antenna pattern, or when a particular cluster attenuation has been reached, as described in more detail below.

DETAILED DESCRIPTION OF THE INVENTION

Figure 1:
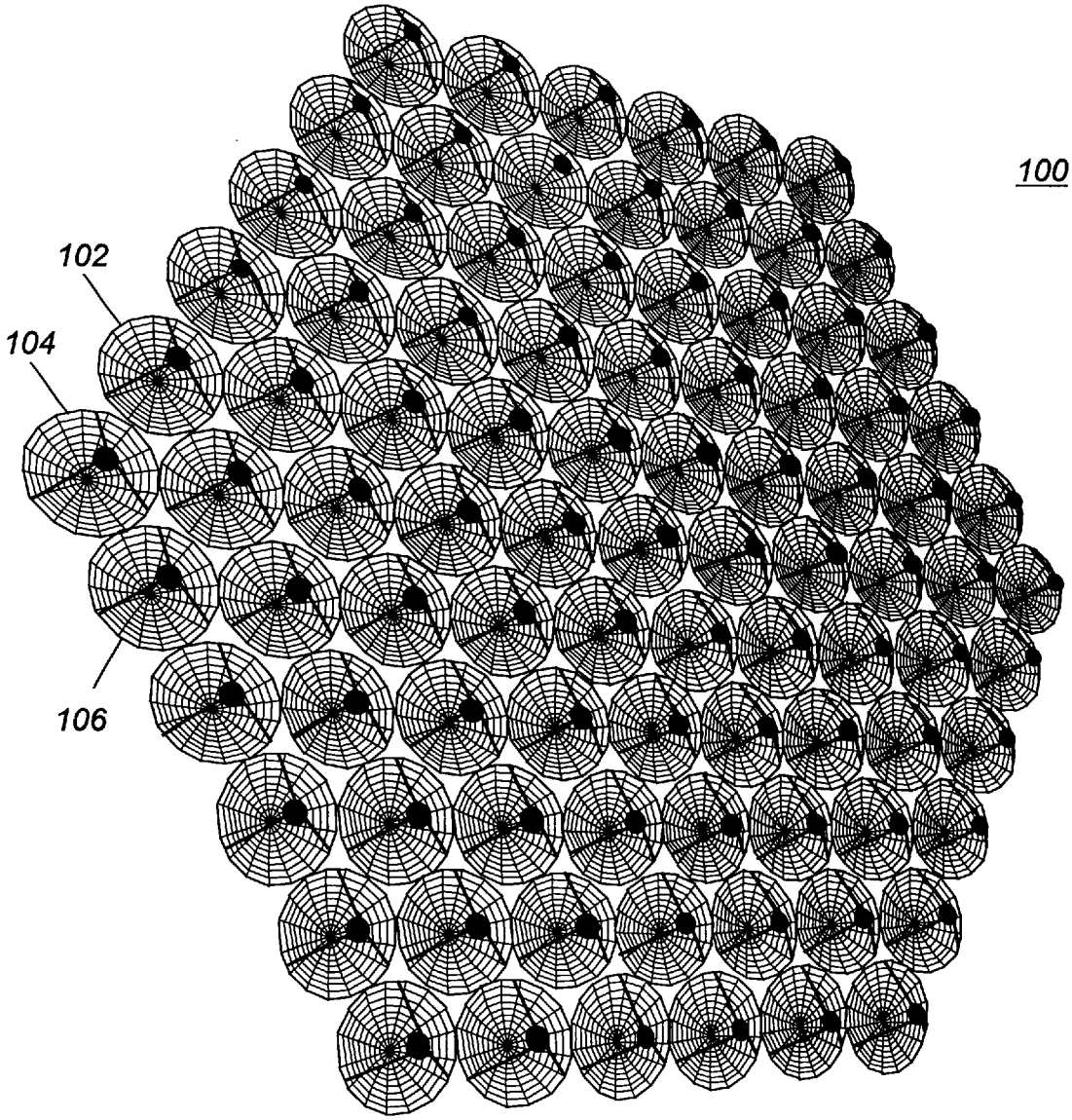
FIG. 1 illustrates a phased reflector array antenna.
Figure 2:
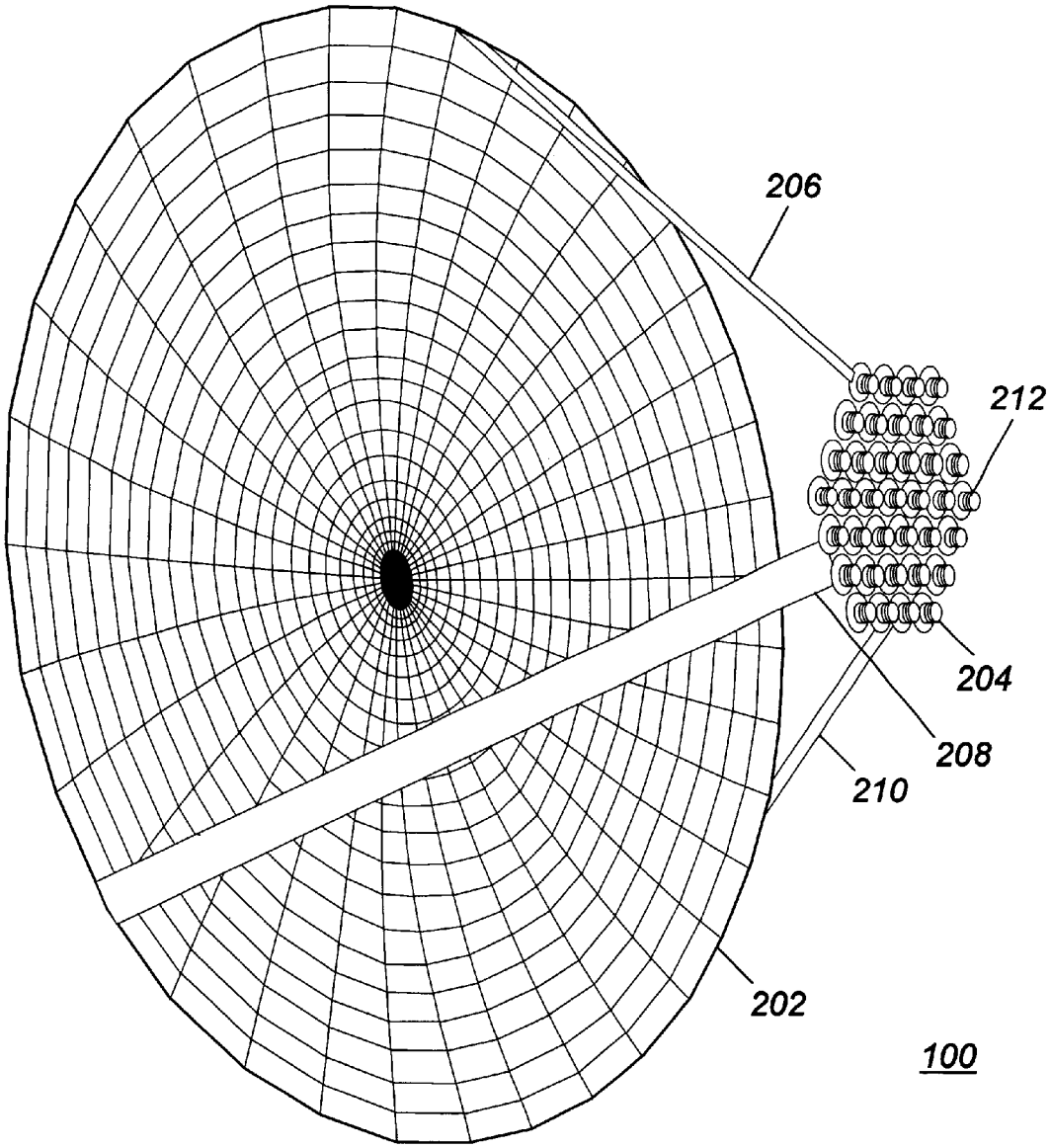
FIG. 2 shows an implementation of a reflector antenna.

Turning now to FIG. 1, that figure shows a deployable phased array of reflectors antenna (DPARA) 100. As shown, the DPARA 100 is formed as an arrangement of reflectors antennas at lattice points of a regular hexagon. Three reflector antennas are designated as reflector antennas 102, 104, and 106. Although FIG. 1 shows 91 identical reflector antennas arranged on a hexagonal reflector lattice to form the DPARA 100, other geometric (e.g., triangular, square, or octagonal) or non-geometric arrangements of identical or non-identical reflector antennas may be controlled in concert to form a DPARA with greater or fewer than 91 reflectors. Furthermore, each reflector antenna 102–106 may be aligned substantially on a periodic lattice, or on a non-periodic or random lattice to reduce grating lobes as described in more detail below. Each reflector antenna 102–106 is preferably formed as a parabolic reflector having an array feed at the focal point as shown in FIG. 2, although the reflector could have any shape (hyperboloid, ellipsoid, spherical, aspherical, etc.). As will be explained in more detail below, each reflector antenna functions as a phased array antenna element to either transmit, receive, or transmit-and-receive signal energy.

Turning to FIG. 2, that figure shows an implementation of a reflector antenna 200 (corresponding, for example, to the reflector antenna 102). The reflector antenna 200 includes a reflector 202, a feed array 204, and supports 206, 208, 210 that hold the feed array 204 preferably at the focal point 212 of the reflector 202. The reflector 202 directs energy out of the reflector antenna or into the feed array 204. A preferred implementation for suspending the feed array 204 above the reflector 202 will be discussed below with reference to FIG. 12.

Figure 3:
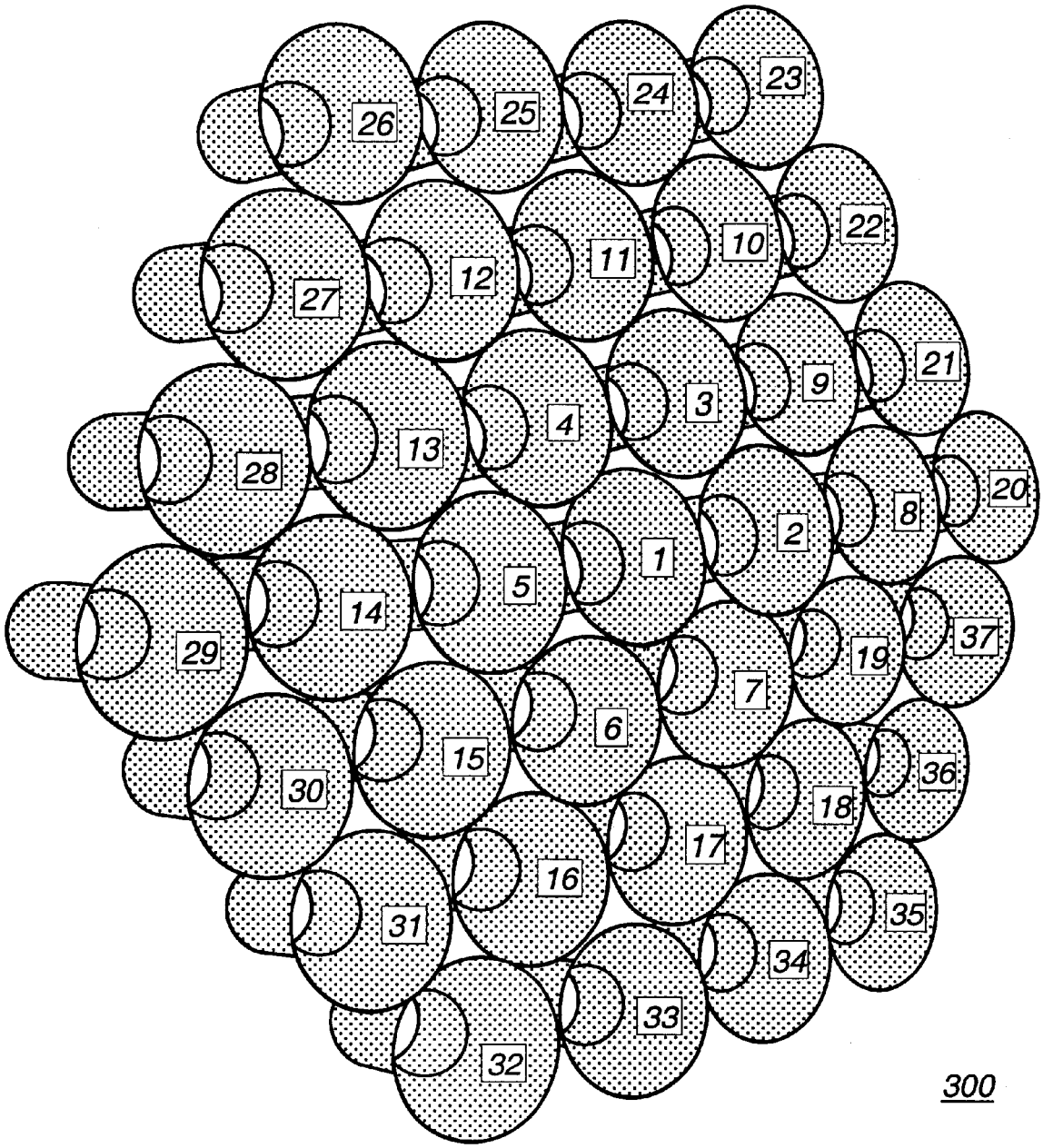
FIG. 3 shows an implementation of a feed array for a reflector antenna.

FIG. 3 presents a more detailed view of a preferred embodiment of a feed array 300. The feed array 300 is formed as an arrangement of 37 feed horns designated 1–37 at lattice points of a regular hexagon. Although FIG. 3 shows 37 identical feed horns arranged on a hexagonal feed lattice to form the feed array 300, other geometric (e.g., triangular, square, or octagonal) or non-geometric arrangements of identical or non-identical feed horns (or other feed elements) may be controlled in concert to form a feed array with greater or fewer than 37 feed horns. Furthermore, each feed horn may be aligned substantially on a periodic lattice, or on an aperiodic lattice to reduce grating lobes as described in more detail below.

The feed horns 1–37 are selectively controlled to form beams using a variable number of the feed horns 1–37. As an example, receiving energy from seven feed horns at a time in a hexagonal arrangement allows the feed array 300 to provide as many as 19 individual transmit/receive communication beams. Feed horns 12–11–13–4–3–5–1, for example, form beam #5, while feed horn s 26–25–27–12–11–13–4 form beam #1. Each reflector preferably uses the same (i.e., corresponding) feed horns to form the same beam (e.g., reflector 102 receives or transmits energy through feed horns 12–11–13–4–3–5–1 to form its contribution to beam #5, and reflector 104 receives or transmits energy through its own corresponding feed horns 12–11–13–4–3–5–1 to form its contribution to beam #5). The number and identity of feed horns that form a beam may be varied between reflectors, however, depending on the application, and the desired DPARA response or pattern.

Figure 4:
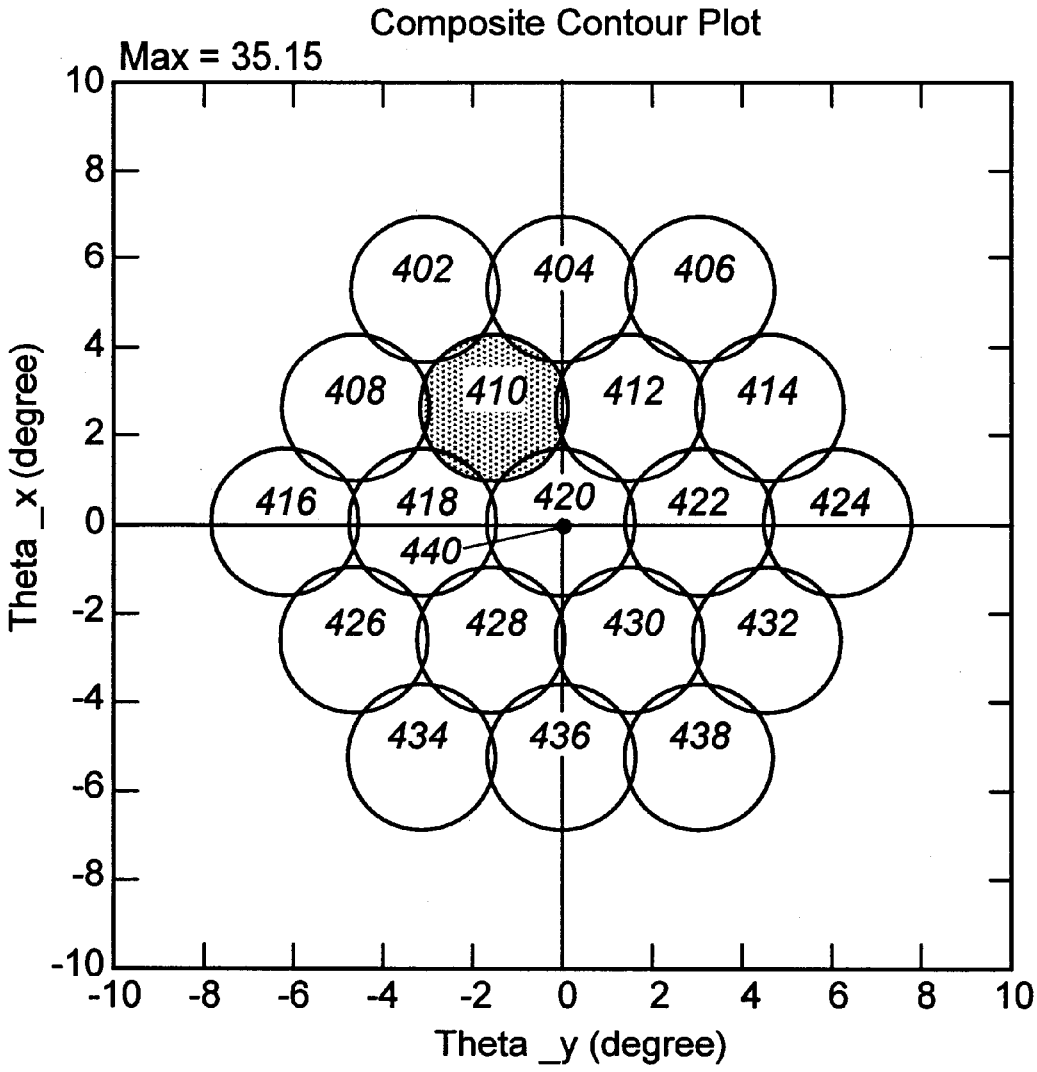
FIG. 4 depicts contours of the half power beamwidths of the beams produced by the array fed reflector.

Referring next to FIG. 4, that figure illustrates a plot 400 of half power contours for beams formed by the reflector antenna 200. As indicated above, the reflector antenna 200 may form 19 beams from hexagonal groups or clusters of seven feed horns. FIG. 4 designates the 19 beams, and their angular locations as beams 402–438. At boresight 440, the central beam 420 results from activating a cluster of feed horns 4–3–5–1–2–6–7. Similarly, the plot 400 designates beam #5 with reference numeral 410 centered at approximately 3.0 degrees X, −1.7 degrees Y with respect to boresight, and designates beam #1 with reference numeral 402 centered at approximately 5.0 degrees X, −3.0 degrees Y with respect to boresight.

Figure 5:
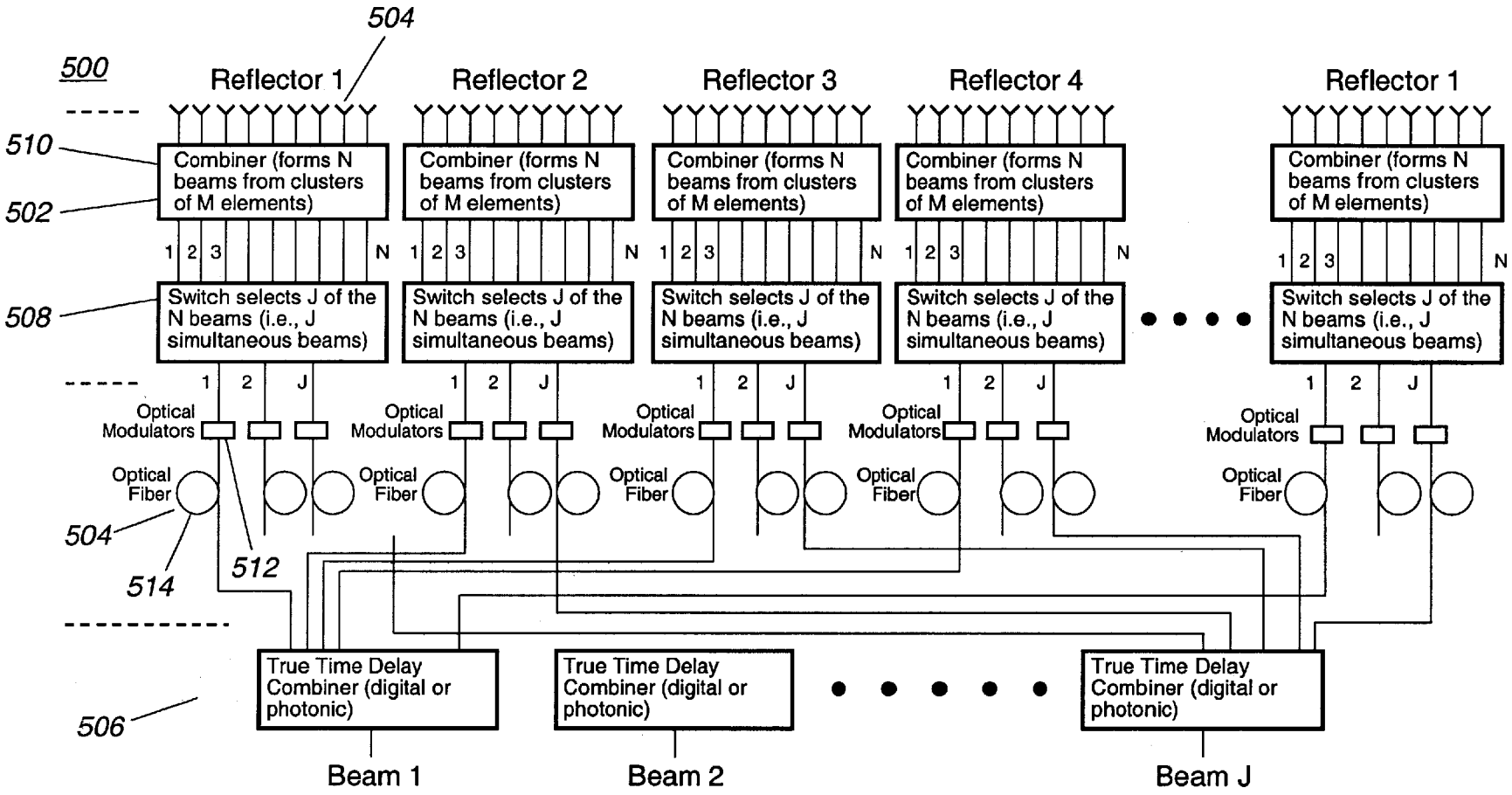
FIG. 5 illustrates one embodiment of a beamforming section for a phased array reflector antenna.

Control over the DPARA 100 is implemented with the beamforming section of the antenna electronics. Turning now to FIG. 5, that figure illustrates a beamforming section 500 adapted to control the DPARA 100. The beamforming section 500 is divided for discussion purposes into three sections: a front end 502, a coupling section 504, and a back end 506.

The front end 502 directly couples to the reflector antennas (i.e., the 91 reflector antennas shown in FIG. 1). Thus, for example, the Reflector 1 labeled in FIG. 5 may correspond to the reflector 102 in FIG. 1, and the feed elements 504 may correspond to the feed horns 1–37. The beamforming section 500 is not limited to any particular number of reflectors or feed horns, however, but may be adapted to any desired implementation. In general, the front end 502 uses for each reflector antenna a combiner (for example, the combiner 510), a switch matrix (for example, the switch matrix 508), and low noise amplifiers for signal reception, or power amplifiers for signal transmission, or both for a combined transmit/receiver antenna (e.g., a radar).

The combiner 510 individually couples signals to and from the reflector and its feed horns. In other words, the combiner 510 forms N beams from clusters of M elements. In the discussion above, M=7 and N may be as great at 19. Thus, for example, the combiner 510 accepts transmit signals for one or more beams, and directs the transmit signals to the feed horns used to form the beams (e.g., feed horns 12–11–13–43–5–1 that form beam #5 and feed horns 26–25–27–12–11–13–4 that form beam #1). The combiner 510 accepts the transmit signals from the switch matrix 508.

The switch matrix 508 is designed to switch any of J inputs to any of N beam outputs in the transmit direction and any of N beam inputs to J outputs in the receive direction. Thus, for example, the beamforming section 500 may communicate over J data streams independently. The switch matrix 508 allows the J data streams to be individually placed or repeated among the N individual beams as desired. The switch matrix 508 communicates with the back end 506 through the coupling section 504.

The coupling section 504 is preferably an optical coupling section. The coupling section 504 therefore preferably includes optical modulators (for example, the optical modulator 512 for data stream 1) and optical fibers (for example, the optical fiber 514) for bi-directional communication between the front end 502 and the back end 506. In other implementations, the coupling section may consist of RF signal paths (e.g., using microstrips and electrical modulators) between the front end 502 and the back end 506.

The back end 506 includes time delay combiners (for example, the time delay combiner 516). In general, a time delay combiner is provided for each beam transmitted or received, and couples, through the front end 502, to each of the reflectors. The time delay combiner 516, for example, is responsible for introducing the time delays or phase shifts and amplitude changes required to steer beam #1 in accordance with phased array antenna principles. The time delay combiner 516 may incorporate photonic time delays (e.g., optical delay lines) and amplitude control, or may incorporate electrical time delays (e.g., radio frequency delay lines) and amplitude control, or may incorporate digital delays (e.g., analog to digital conversion, followed by a processor).

Note, however, that in the present phased reflector array antenna, the transmit/receive elements are not simply direct radiating elements, but are complete reflector antenna structures. As noted above, the reflector antenna structures include a feed array configurable to provide numerous beams using numerous clusters of feed horns or other feed elements. One benefit of the present phased reflector array antenna is that it provides scanning capability in accordance with phased array antennas, while providing large, lightweight aperture size in accordance with deployable reflector antennas.

Figure 6:
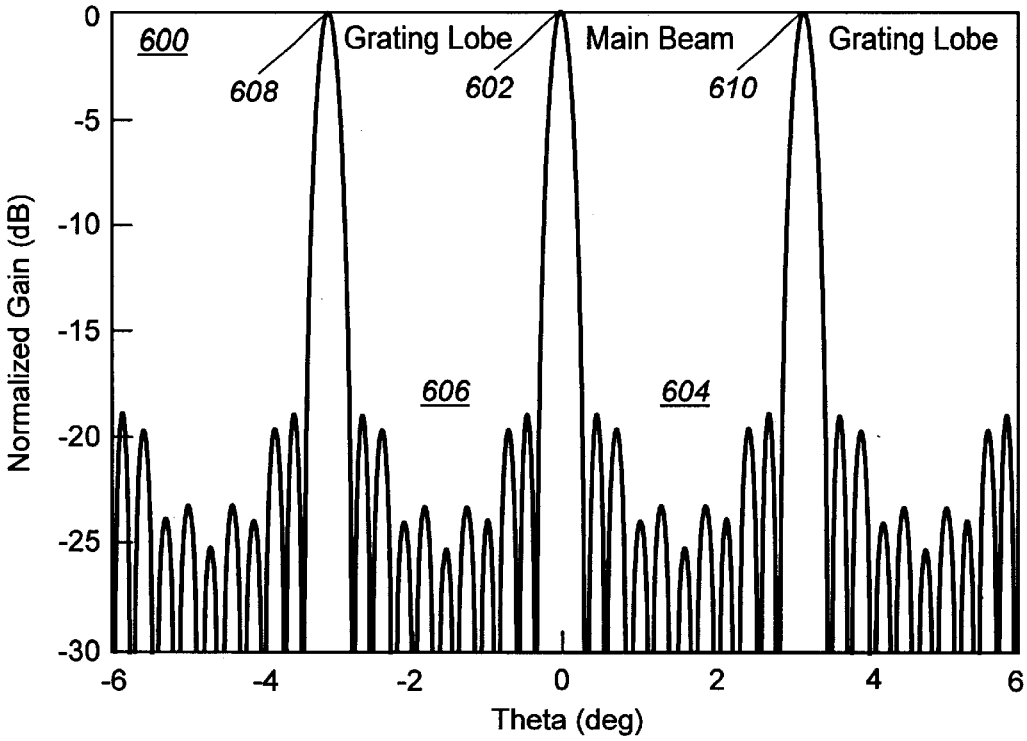
FIG. 6 shows an ideal array pattern produced by an array of isotropic sources.

Turning next to FIG. 6, that figure illustrates an array pattern 600. The array pattern 600 includes a main lobe 602, side lobes 604 and 606, and grating lobes 608 and 610. The array pattern 600 represents the antenna response of the hexagonal array of reflectors of the DPARA 100 shown above in FIG. 1, under the assumption that each reflector is an ideal point source radiator. Due in part to the spacing between reflectors, the array pattern 600 for the DPARA 100 includes the grating lobes 608 and 610 that generally represent undesired antenna response. In fact, however, the reflectors are not ideal radiators. Rather, as noted above, each reflector uses a feed array through which energy is transmitted and received (that is, an array-fed reflector). Thus, the total antenna pattern for the DPARA 100 is the product of the array pattern and the array-fed reflector patterns.

Figure 7:
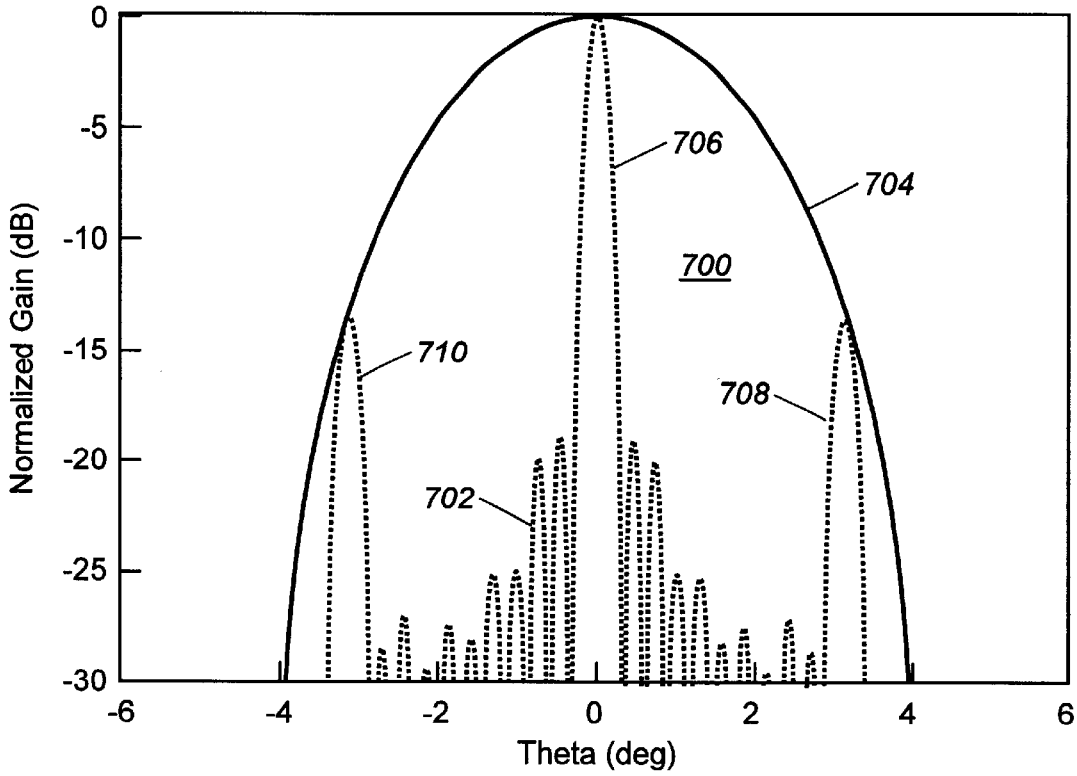
FIG. 7 shows a portion of a phased reflector array antenna pattern formed as the product of an ideal array pattern and an array fed reflector element pattern.

Turning now to FIG. 7, that figure illustrates a portion of a phased reflector array antenna pattern 700 including sidelobes 702. The array pattern 700 is formed as the product of a reflector array pattern (e.g., the reflector array pattern 600) and the array-fed reflector pattern 704. The array pattern 700 includes a main lobe 706, and grating lobes 708 and 710. Note, however, that the array-fed reflector pattern 704 significantly attenuates the grating lobes 706 and 708, and completely eliminates ideal array pattern grating lobes outside the array-fed reflector pattern 704 (because the array pattern 700 is the product of an ideal array pattern and the array-fed reflector pattern 704).

The array-fed reflector patterns are generally the antenna patterns associated with a reflector illuminated by a cluster of feed horns activated to form a beam. Thus, the array-fed reflector pattern 704 may be the antenna pattern associated with the central beam 420 generated using a cluster of feed horns 4–3–5–1–2–6–7 (as shown in FIGS. 3 and 4 and described above). Note again that there may be many possible beams for each reflector, and therefore many possible array-fed reflector patterns. For example, groups of seven feed horns 1–37 may be used to form any of 19 beams (and therefore any of 19 feed array patterns that modify the ideal reflector array pattern) in the implementation set forth above.

Figure 8:
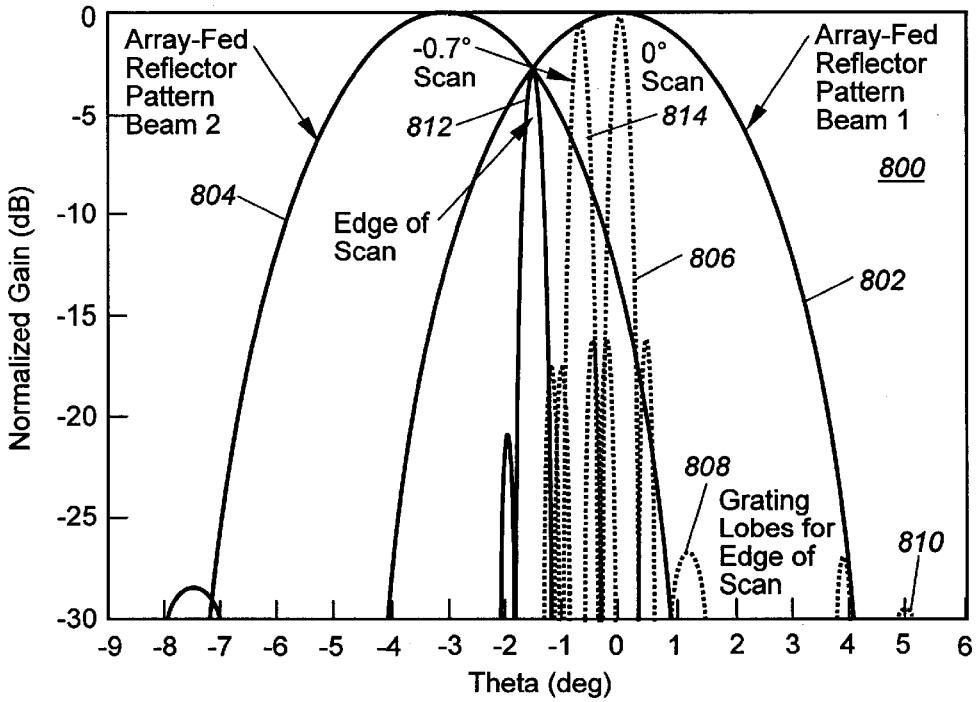
FIG. 8 illustrates composite and array fed reflector element patterns produced by two adjacent seven feed horn clusters in a phased reflector array antenna.

Turning to FIG. 8, for example, that figure shows a plot 800 of the array-fed reflector patterns produced by two adjacent seven feed horn clusters in product with an array-fed reflector pattern. The plot 800 shows a beam 1 array-fed reflector pattern 802, a beam 2 array-fed reflector pattern 804, and a total antenna pattern generally indicated as reference numeral 806. Also present in the plot 800 are an edge-of-scan grating lobe 808, a mid scan grating lobe 810, and an array feed (or beam) transition point 812. The grating lobe 808 is associated with the scanning angle at the transition point 812, while the grating lobe 810 is associated with a negative 0.7 degree scanning angle (point 814).

The array feed transition point 812 defines one edge of scan (i.e., a predetermined angular limit over which a beam will be scanned) for beam 1 and beam 2. In other words, as the DPARA 100 scans past the transition point 812 to more negative steering angles, the switching electronics 508 preferably deactivate the cluster of feed horns that generate beam 1 and activate the cluster of feed horns that generate beam 2. Similarly, as the DPARA 100 scans past the transition point 812 to more positive angles, the switching electronics 508 preferably activate the cluster of feed horns that generate beam 1 and deactivate the cluster of feed horns that generate beam 2.

Although the feed array patterns significantly attenuate grating lobes, any physically realizable reflector and feed array implementation will have additional grating lobes that rise or fall depending on the angle to which the antenna steers. Such grating lobes and total antenna response may be modeled with commercially available antenna design software. As an example, FIG. 8 shows that at negative 0.7 degree scan point 814, the grating lobe 810 appears. The grating lobe 810 has extremely small response (approximately −30db), and depending on the application, may not be cause for concern. At the edge-of-scan (transition point 812), however, the grating lobe 808 appears. The grating lobe 808 approaches −27db in response. In general, as the scan angle increases, grating lobes become more significant.

The placement of the transition point 812 is a design choice which may reflect when grating lobes become significant, or may reflect a desire to not steer past a predetermined attenuation of a feed array, for example. Thus, in FIG. 8, the transition point 812 is placed at the −3db (half power) point for the clusters of feed horns that generate beam 1 and beam 2. In other implementations, the transition point 812 is selected according to a minimum acceptable grating lobe specification that represents a threshold at or below which the grating lobe response is acceptable for the application in question.

For example, the minimum acceptable grating lobe specification may be between −15db and −27db in certain sensitive communication applications. If even greater grating lobe isolation is desired, the grating lobe specification may be set lower (for example, between −20db and −27db). The grating lobe specification may vary considerably between applications (e.g., RADAR, communications, or imaging applications).

Figure 9:
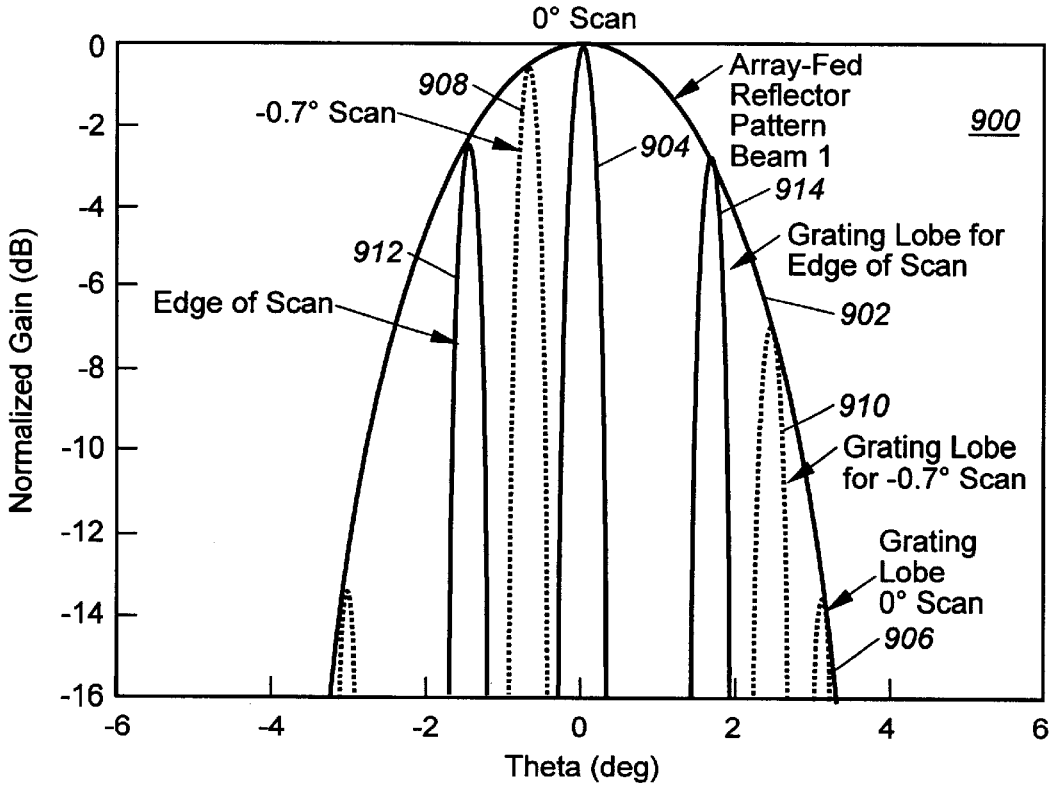
FIG. 9 illustrates an antenna pattern produced in a particular plane by a phased reflector array antenna.

Turning next to FIG. 9, that figure illustrates a plot 900 of total antenna response within beam 1 feed array pattern 902, for steering in a particular worst case plane. A zero degree scan point 904, and associated grating lobe 906 are shown, as are a negative 0.7 degree scan point 908 and associated grating lobe 910, and an edge of scan point 912 and associated grating lobe 914. Because the magnitude of the grating lobe response may increase in certain planes, additional grating lobe suppression techniques may be employed to minimize the effects of the grating lobes 906, 910, 914. Thus, for example, the reflectors or feed horns may be offset from the their substantially periodic lattice points by pseudo random offsets. Such offsets may be modeled with antenna design software and are often effective to reduce grating lobes.

Figure 10:
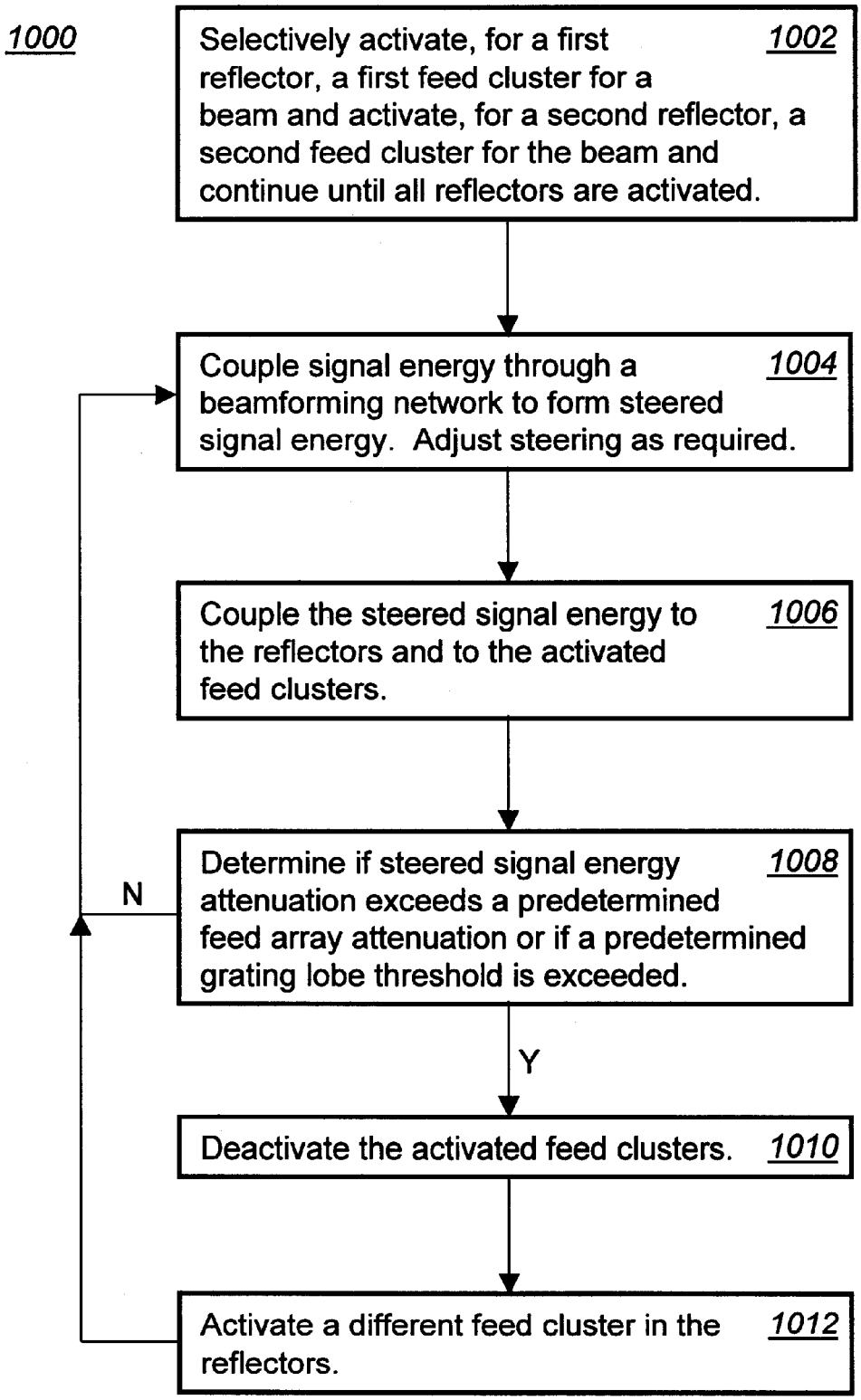
FIG. 10 shows a flow diagram of phased reflector array antenna operation.

Turning next to FIG. 10, that figure presents a flow diagram 1000 of phased reflector array antenna operation. Although described with respect to two feed clusters and reflectors, the principles of this invention apply to N number of feed clusters and reflectors. At step 1002, the DPARA 100 selectively activates a first feed cluster to form a beam directed through a first reflector. In addition, the DPARA 100 activates a second feed cluster to form the same beam directed through a second reflector. As one example, the first reflector may be the reflector 102 and the second reflector may be the reflector 104. Again, as an example, the first feed cluster may include the feed horns 12–11–13–4–3–5–1 (FIG. 3), to form beam #5 and the second feed cluster may include the feed horns 12–11–13–4–3–5–1 to form its own beam #5.

Signal energy, either in the transmit or receive direction, is then coupled through the beamforming section 500 to form steered signal energy (step 1004). The DPARA 100 couples, at step 1006, the steered signal energy between the reflectors and the activated feed clusters to generate the beams supported by the feed clusters. Next, at step 1008, the DPARA 100 determines whether the steered signal energy is being attenuated beyond a predetermined feed array attenuation, or if a predetermined grating lobe threshold has been exceeded, as described above.

If either condition is met, the DPARA 100 deactivates the currently activated feed clusters at step 1010. The DPARA 100 then activates, preferably, neighboring (adjacent) feed clusters at step 1012. In other words, the DPARA 100 activates a different feed cluster for all reflectors (the same feed cluster in each) to reduce or eliminate the undesired attenuation or grating lobe effects. Operation continues at step 1004, where additional beam steering occurs.

Figure 11:
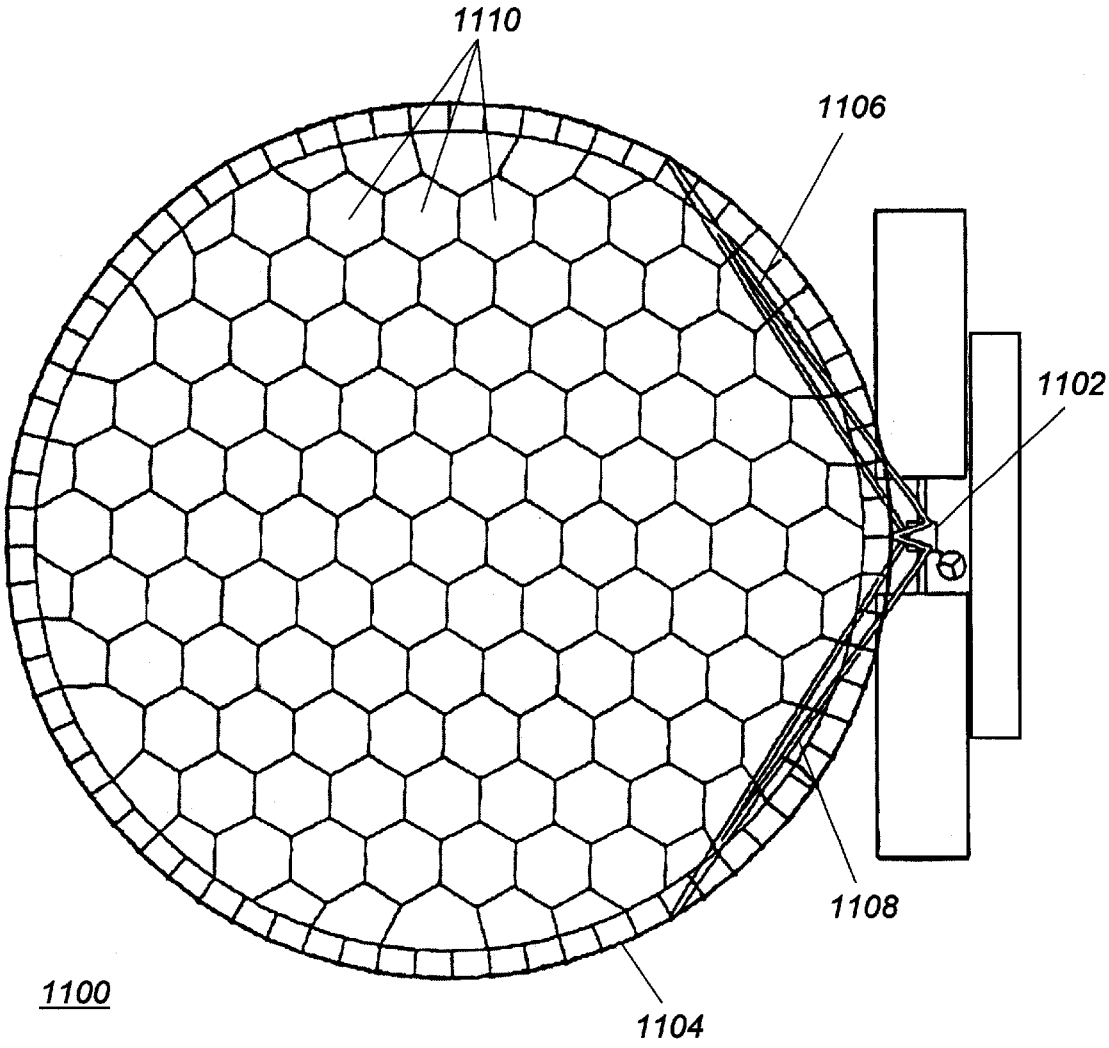
FIG. 11 illustrates a top down view of a phased reflector array antenna deployed from a satellite.

Turning now to FIG. 11, that figure illustrates a top down view of a DPARA 1100 implementation as deployed from a satellite 1102. The DPARA 1100 is supported by an outer deploying ring 1104 which in turn is supported, for example, by graphite deployable tubes 1106 and 1108 extending from the satellite 1102. The outer ring 1104 may be, for example, a Deployable Perimeter Truss Reflector ring as disclosed in TRW docket No. 11-0925, Ser. No. 09/080,767, filed May. 8, 1998. The DPARA 1100 is formed from numerous individual reflector antennas 1110, arranged adjacent to one another (and sharing support structure at interface boundaries as noted below) to form a steerable phased array antenna as described above in connection with FIG. 1. A preferred implementation of a reflector antenna 1110 is illustrated in FIG. 12.

Figure 12:
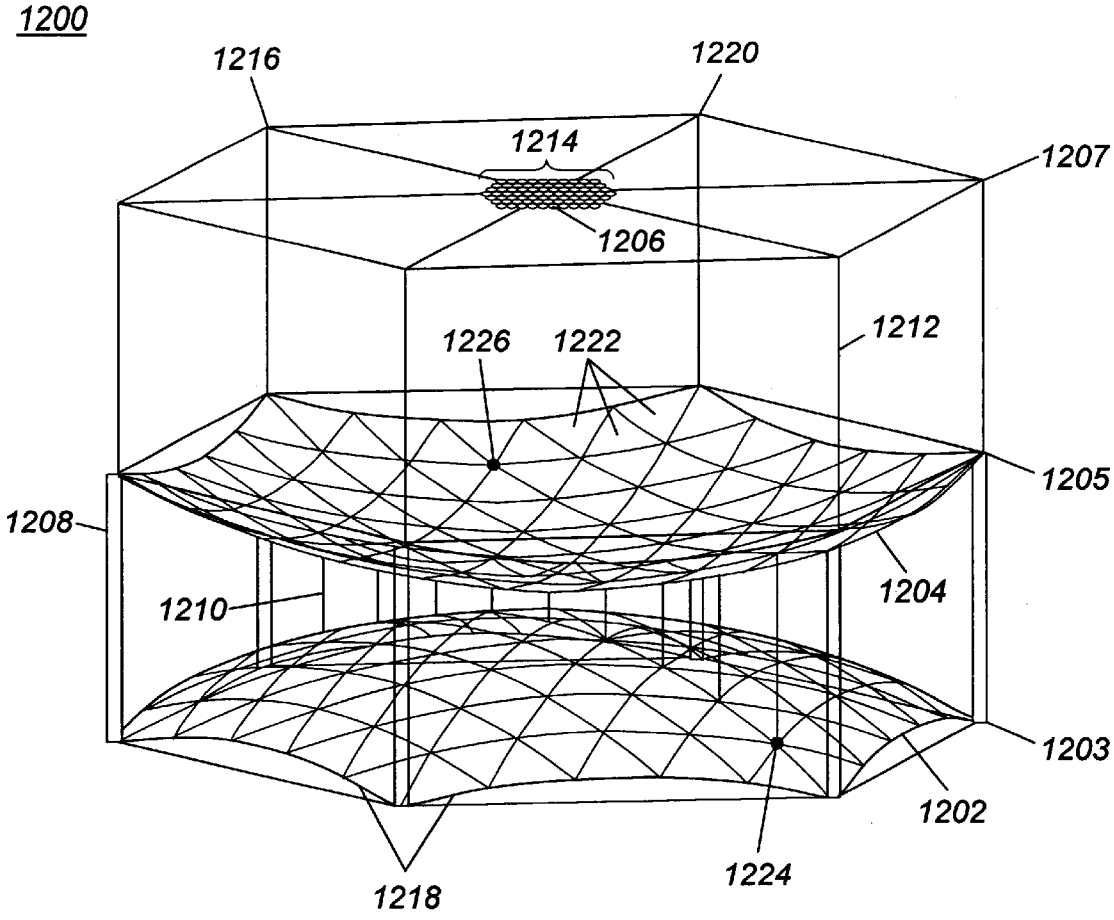
FIG. 12 depicts a single reflector antenna.

Turning now to FIG. 12, that figure shows a single reflector antenna 1200. The reflector antenna 1200 includes a shaping surface 1202 (in the bottom plane 1203 of the reflector antenna 1200), a reflector surface 1204 (in the middle plane 1205 of the reflector antenna 1200), and a feed array 1206 (in the upper plane 1207 of the reflector antenna 1200). The feed array 1206 may be a feed array such as that described in detail above with respect to FIG. 3. Rigid graphite posts 1208 and drop ties 1210 (located at each vertex of the triangles formed in the shaping nets) are present between the shaping surface 1202 and the reflector surface 1204. The rigid posts 1208 define points of a hexagonal periphery for the reflector antenna 1200 and are designed to carry the loads created by drop ties 1210. Optional tension lines 1212 run between the reflector surface 1204 and the upper plane 1207 of the reflector antenna 1200.

In a preferred embodiment of the reflector antenna 1200, the reflector antenna perimeter 1200 is hexagonal in shape. The periphery 1216 of each reflector antenna may then be formed using non-dielectric material (such as graphite fiber or tape) periphery lines 1218 at the upper, middle, and bottom planes of the reflector antenna 1200. The periphery lines 1218 thus form hexagonal support webs for the reflector antenna 1200, including for the reflector surface 1204 and the shaping surface 1202. Tension lines 1214 formed from a dielectric material (which are ultimately tensioned by deployment of the outer ring 1104) are present to support the feed array 1206. The individual feed elements may be secured to a mechanical fixturing or plate, which in turn is secured to the tension lines 1214 using a miniature cable connection. Joints 1220 are preferably formed at the six corners of each hexagon to secure the tension lines 1214 and periphery lines 1218 and to define the hexagonal periphery of the reflector antenna 1200 when the lines are tensioned upon deployment.

As noted above, the rigid posts 1208 define corner points on a hexagonal periphery 1216. The drop ties 1210 are spring loaded in different amounts to form the parabolic shape of the reflector surface 1204. The opposite shape is correspondingly assumed in the shaping surface 1202. In other words, the drop ties 1210 closer to the center of the reflector surface 1204 have different loading than drop ties in the center and outer edges. This is required to properly load the reflector surface 1204 and the shaping surface 1202. The load of the drop ties 1210 is individually controlled to form a reflector surface 1204 of desired curvature. The number of drop ties 1210 and their spacing (which may range for example, from 4 to 24 inches) determines the smoothness or accuracy of the reflector surface 1204. The number of drop ties 1210 increases as the frequency of operation of the reflector antenna 1200 increases, and as the amount of curvature increases. In one implementation, 396 drop ties 1210 are spaced at 29 inches in a 50 foot reflector with a F/D=1.0 to form the reflector surface for operation at approximately 8 GHz.

The reflector surface 1204 may be formed using Tricot™ knit mesh of Molybdenum wire with approximately 10 openings per inch. The Molybdenum is preferably gold plated and may be approximately 1.0–1.2 thousandths in diameter, although other diameters are suitable depending on the application. The reflector surface 1204 is formed from a number of triangular (preferably) sections referred to as flat facets (shown, for example, in FIG. 12 as flat facets 1222). The flat facets are defined by vertex points, for example, the flat facet vertex 1226. The shaping surface 1202 may be formed using flat open facets formed from high tensile lines modulus or tapes that meet and are secured at the flat facet vertices (e.g., the vertex 1224). Note that the drop ties 1210 may be secured by rivets in laser controlled tooling holes in the dielectric lines or tapes and the Molybdenum wire mesh at the flat facet vertices (e.g., the vertices 1224 and 1226). The mesh is attached to the reflector surface 1204 which provides the parabolic shape in the mesh.

Figure 13:
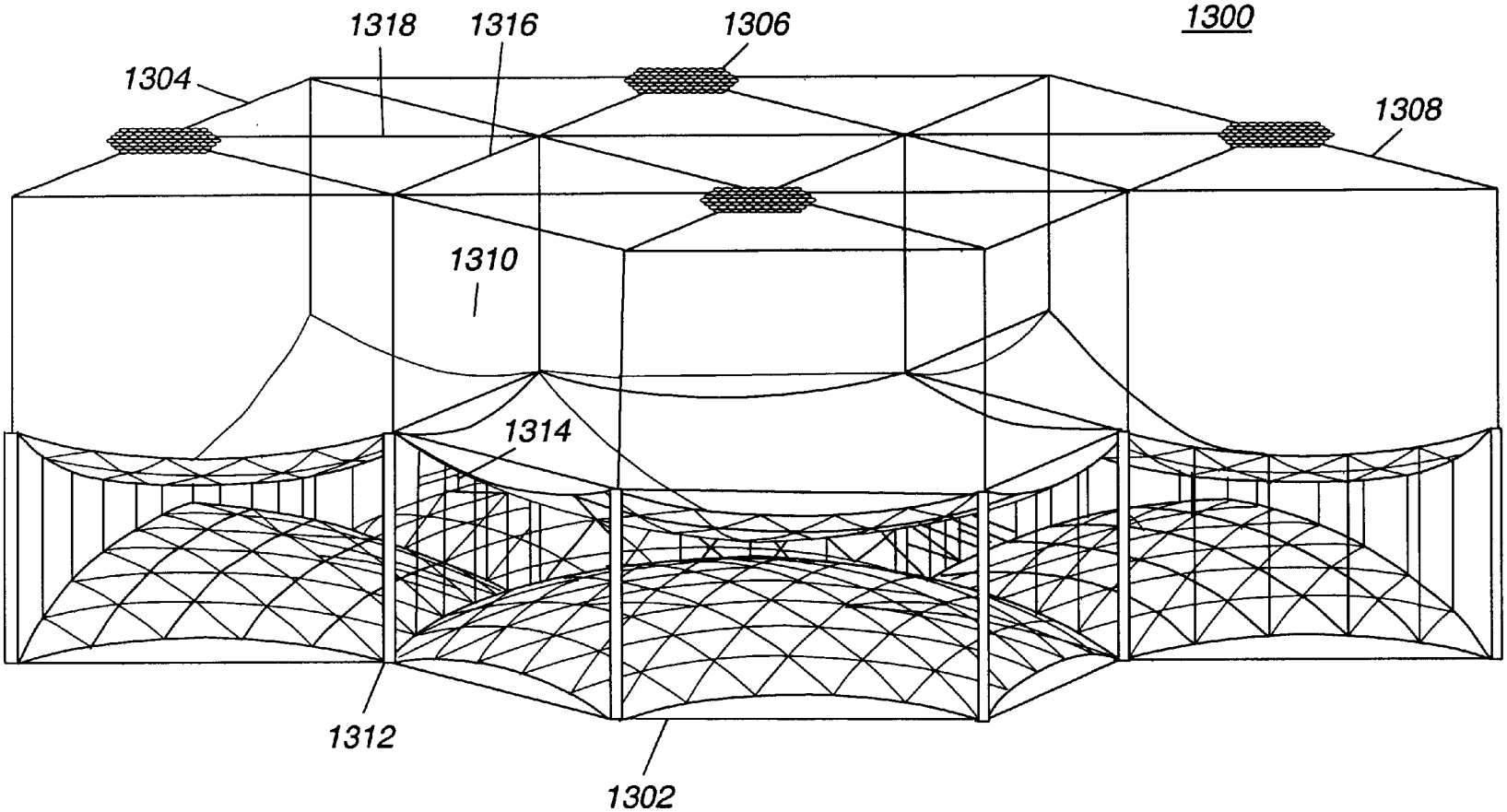
FIG. 13 shows interface boundaries between reflector antennas.

Turning now to FIG. 13, that figure illustrates a DPARA section 1300 including the reflector antenna 1302, and portions of reflector antennas 1304, 1306, and 1308. The reflector antennas 1302–1308 may be formed as noted above with regard to FIG. 12. Note that adjacent reflector antennas share certain interface boundaries (i.e., a plane common to one side of adjacent reflector antennas). For example, the reflector antenna 1302 shares the interface boundary 1310 with the reflection antenna 1304. The reflector antennas 1302 and 1304 may therefore share common rigid posts (e.g., rigid post 1312), drop ties (e.g., drop tie 1314), and periphery lines (e.g., periphery line 1316). Sharing interface boundaries helps the DPARA significantly reduce weight, cost, and size by eliminating unnecessary duplication of structural elements.

Figure 14:
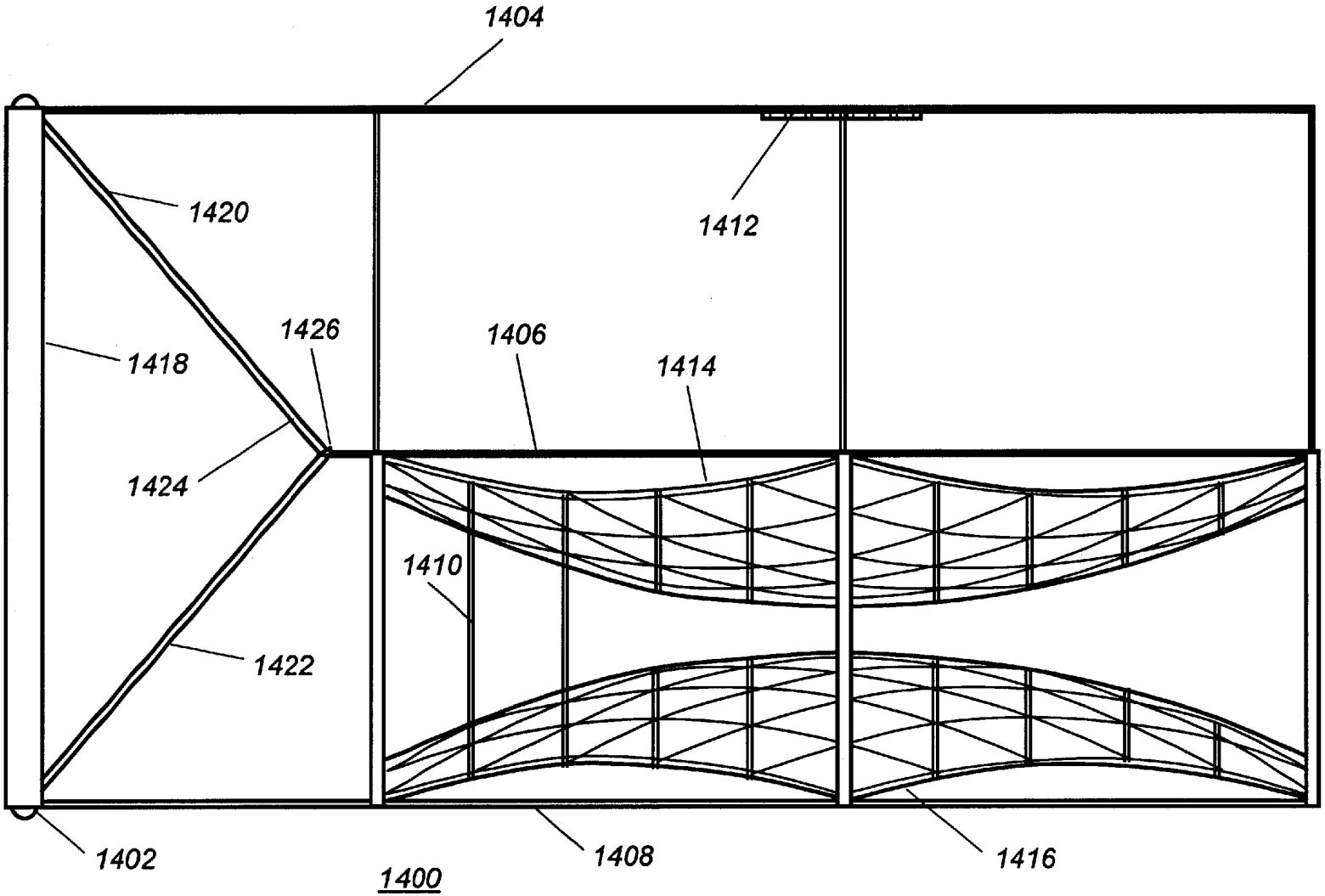
FIG. 14 illustrates the connection between a reflector antenna and an outer ring structure.

Turning next to FIG. 14, that figure illustrates a side view of a DPARA section 1400 and its connection to an outer ring 1402 (e.g., as shown above in FIG. 11 as the outer ring 1104). FIG. 14 illustrates the position of the hexagonal support webs 1404, 1406, and 1408, as well as the drop ties 1410, feed array 1412, reflector surface 1414, and shaping surface 1416. The outer ring 1402 may be formed from individual bays formed from horizontal and vertical graphite support members (e.g., vertical support member 1418).

The outer ring 1402, when deployed as shown in FIG. 14, provides a deployable tensegrity truss 1420 to tension the hexagonal support webs 1404–1408 and pull the DPARA 1400 into shape. The truss 1420 is preferably formed using bundles of graphite filamentary tension lines (two bundles of which are illustrated as tension lines 1420 and 1422) from each of four corners of each bay. The tension lines meet at a point (e.g., point 1426) to form pyramidal structures. A hoop line (not shown) runs around the pyramidal structures at points 1426 and serves to tension the pyramidal tension lines. Upon deployment of the outer ring 1402, the structure of the DPARA 1400 pulls into shape.

Thus, the present phased reflector array antenna provides a large effective aperture antenna that is also steerable over a significant angular range in an implementation that is practical from economic and engineering standpoints. Furthermore, the present phased reflector array antenna has characteristics of both reflector antennas and phased array antennas and is therefore able to handle high gain (narrow) beams without overheating and related performance degradation. The present phased reflector array antenna further provides a significant reduction in stowed size and weight, and therefore cost, to launch.

While the invention has been described with reference to a preferred embodiment, it will be understood by those skilled in the art that various changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

What is claimed is:

1. A phased-array-of-reflectors antenna comprising:

plurality of reflector antennas pointed toward a common direction each comprising a reflector having a rim defining a substantially circular shape and each comprising a feed array disposed above the individual reflector;

each reflector antenna being disposed adjacent to at least one other reflector antenna in the plurality of reflector antennas to form a phased array antenna using the plurality of reflector antennas as phased array antenna elements so that the signal energy from the plurality of reflector antennas combines to form a beam.

2. A phased reflector array according to claim 1, wherein the plurality of reflectors comprises four or more individual reflectors arranged substantially on a periodic reflector lattice.

3. A phased reflector array according to claim 2, wherein at least one of the feed arrays comprises four or more individual feeds arranged substantially on a periodic feed lattice.

4. A phased reflector array antenna according to claim 3, wherein the periodic feed lattice is a periodic hexagonal feed lattice.

5. A phased reflector array according to claim 2, wherein at least one of the feed arrays comprises four or more individual feeds arranged substantially on a aperiodic feed lattice.

6. A phased reflector array antenna according to claim 2, wherein each feed array is disposed at a corresponding individual reflector focal point.

7. A phased reflector array antenna according to claim 2, wherein the periodic reflector lattice is a periodic hexagonal reflector lattice.

8. A phased reflector array according to claim 1, wherein the plurality of reflector antennas comprises four or more individual reflectors arranged on an aperiodic lattice.

9. A phased reflector array antenna according to claim 1, further comprising:

phase and amplitude control means coupled to each individual reflector for steering the individual reflectors.

10. A phased reflector array antenna according to claim 1, further comprising switching means coupled to the feed arrays for selectively activating and deactivating feeds in the feed arrays.

11. A phased reflector array antenna according to claim 10, wherein the switching means is a switch matrix for selectively activating and deactivating at least first and second element clusters of feeds that form a beam.

12. A phased reflector array antenna according to claim 11, wherein the switch matrix deactivates the first element cluster and activates the second element cluster when the beam steers within a predetermined angular range of the first element cluster.

13. A phased reflector array antenna according to claim 12, wherein the predetermined angular range is selected according to a minimum acceptable grating lobe specification.

14. An antenna pattern for a phased reflector array antenna, the antenna pattern comprising a reflector array pattern in product with array-fed reflector patterns, the reflector array pattern generated by a lattice of four or more reflector antennas, the pattern from each of said reflector antennas comprising a substantially circular shape, and the array-fed reflector patterns generated by selectively actuable array feeds above the reflector antennas.

15. An antenna pattern according to claim 14, wherein the reflector array pattern is a reflector array pattern corresponding to a lattice of reflector antennas disposed adjacent to one another.

16. An antenna pattern according to claim 14, wherein at lest one of the array-fed reflector patterns is an array feed pattern corresponding to an array feed comprising individual feeds arranged in a lattice.

17. An antenna pattern according to claim 14, wherein the reflector array pattern is a reflector array pattern corresponding to a substantially hexagonal lattice of reflector antennas.

18. An antenna pattern according to claim 14, wherein at least one of the array-fed reflector patterns is an array-fed reflector pattern corresponding to a feed array illuminating a reflector and comprising individual feeds arranged in a hexagonal lattice.

19. A method for generating a steerable antenna pattern, the method comprising:

coupling signal energy through a beamforming section to form steered signal energy;

selectively activating a first feed cluster for a beam and a second feed cluster for the beam, the first feed cluster selected from feed elements in a first feed array for a first reflector antenna, the second feed cluster selected from feed elements in a second feed array for a second reflector antenna, the first and second reflector antennas being pointed toward a common direction and being adjacently disposed to form a phased array reflector antenna using the first and second reflector antennas as phased array antenna elements so that the signal energy from the first and second feed clusters combines to form said beam; and coupling the steered signal energy between the first and second reflector antennas and the first and second feed clusters.

20. A method according to claim 19, wherein the step of coupling steered signal energy comprises coupling signal energy to the first and second reflector antennas and to the first and second feed clusters to transmit the signal energy.

21. A method according to claim 19, wherein the step of coupling steered signal energy comprises coupling signal energy from the first and second reflector antenna and from the first and second feed clusters to receive the signal energy.

22. A method according to claim 19, wherein the step of coupling steered signal energy further comprises first coupling the steered signal energy between the first and second reflector antennas arranged on a substantially hexagonal reflector array lattice.

23. A method according to claim 19, wherein the step of coupling steered signal energy between the first and second feed clusters further comprises coupling the steered signal energy between first and second feed clusters arranged on a substantially hexagonal lattice.

24. A method according to claim 19, further comprising the step of steering the signal energy to a predetermined angle using the beamforming section.

25. A method according to claim 19, further comprising the step of selectively deactivating the first feed cluster and activating a third feed cluster for a second beam and selectively deactivating the second feed cluster and activating a fourth feed cluster for the second beam, the third feed cluster selected from feed elements in the first feed array, the fourth feed cluster selected from feed elements in the second feed array.

26. A method according to claim 25, wherein the step of deactivating the first feed cluster and the step of deactivating the second feed cluster occur when the steered signal energy experiences a predetermined attenuation.

27. A method according to claim 26, wherein the step of deactivating the first feed cluster and the step of deactivating the second feed cluster occur when a predetermined minimum acceptable grating lobe specification is exceeded.

28. A phased reflector array antenna comprising:

a plurality of reflector antennas pointed toward a common direction each comprising a reflector and a feed array, the feed array disposed above the reflector, the reflector comprising a reflector surface pulled into shape by a plurality of drop ties coupled to a shaping surface, and wherein each reflector antenna is disposed adjacent to at least one other reflector antenna and shares at least one of said drop ties with said one other reflector antenna in the plurality of reflector antennas to form a phased array antenna using the plurality of reflector antennas as phased array antenna elements to form a communication beam.

29. The phased reflector array antenna of claim 28, wherein the drop ties may be spring loaded drop ties.

30. The phased reflector array antenna of claim 28, wherein the individual reflector antennas have a hexagonal periphery, and wherein a portion of the hexagonal periphery is shared with an adjacent reflector antenna in the plurality of reflector antennas.

31. The phased reflector array antenna of claim 30, further comprising rigid support posts located at corner points of the hexagonal periphery.

32. The phased reflector array antenna of claim 30, further comprising a hexagonal support web around a hexagonal periphery of the shaping surface.

33. The phased reflector array antenna of claim 30, further comprising a hexagonal support web around a hexagonal periphery of the reflector surface.

34. The phased reflector array antenna of claim 30 further comprising a hexagonal support web around a hexagonal periphery of the feed support plane surface.

35. The phased reflector array antenna of claim 28, wherein the reflector surface is an elastic RF material reflector surface.

36. The phased reflector array antenna of claim 28, wherein the reflector surface comprises a plurality of flat facets, and wherein the drop ties are secured at vertex points of the flat facets.

37. The phased reflector array antenna of claim 36, wherein the flat facets are triangular flat facets.

38. The phased reflector array antenna of claim 28, wherein the shaping surface comprises a plurality of flat facets, and wherein the drop ties are secured at vertex points of the flat facets.

* * * * *